US009365326B2

(12) United States Patent
Bois

(10) Patent No.: US 9,365,326 B2
(45) Date of Patent: Jun. 14, 2016

(54) RESEALABLE PACKAGING BAG AND CLOSING ASSEMBLY FOR SAME

(75) Inventor: Henri Bois, Neuilly-sur-Seine (FR)

(73) Assignee: S2F Flexico (FR)

( * ) Notice: Subject to any disclaimer, the term of this patent is extended or adjusted under 35 U.S.C. 154(b) by 446 days.

(21) Appl. No.: 12/638,108

(22) Filed: Dec. 15, 2009

(65) Prior Publication Data

US 2010/0150477 A1 Jun. 17, 2010

(30) Foreign Application Priority Data

Dec. 17, 2008 (FR) ..... 08 58680

(51) Int. Cl.
*B65D 33/25* (2006.01)

(52) U.S. Cl.
CPC ..... *B65D 33/2541* (2013.01); *B65D 33/2508* (2013.01)

(58) Field of Classification Search
CPC ..... B65D 33/25; B65D 33/2533; B65D 33/2541; B65D 33/2516; B65D 33/255; B65D 33/2558; B65D 33/2591; B65D 33/2508; B65D 33/2525; B65D 33/2566; A44B 19/16
USPC ..... 383/63, 210, 210.1, 61.2, 64, 65; 24/399, 400, 585.12, DIG. 38–DIG. 40
See application file for complete search history.

(56) References Cited

U.S. PATENT DOCUMENTS 2,916,197 A * 12/1959 Lingenfelter et al. ..... 206/219
3,173,184 A * 3/1965 Ausnit ..... 24/399
4,285,376 A * 8/1981 Ausnit ..... 383/203
4,516,268 A * 5/1985 Kamp ..... 383/63
4,736,451 A * 4/1988 Ausnit ..... 383/65
4,817,188 A * 3/1989 Van Erden ..... 383/63
4,863,286 A * 9/1989 Branson ..... 383/63
4,878,763 A * 11/1989 Ausnit ..... 383/65
5,017,021 A * 5/1991 Simonsen et al. ..... 383/63
5,065,899 A * 11/1991 Tilman ..... 221/305
5,272,794 A * 12/1993 Hamatani et al. ..... 24/586.1
6,167,597 B1 * 1/2001 Malin ..... 24/585.1
6,185,796 B1 * 2/2001 Ausnit ..... 24/585.1

(Continued)

FOREIGN PATENT DOCUMENTS

JP 9-077096 A 3/1997
JP 09077096 A * 3/1997 ..... B65D 33/25
WO 2006/041057 A1 4/2006

OTHER PUBLICATIONS

JP09-077096A Translation.*

(Continued)

*Primary Examiner* — Jes F Pascua
*Assistant Examiner* — Nina Attel
(74) *Attorney, Agent, or Firm* — Lerner, David, Littenberg, Krumholz & Mentlik, LLP

(57) ABSTRACT

The present invention concerns a bag comprising a closing assembly (100) comprising two complementary elements (110, 120) supported by respective webs (112, 122) at least one of which is integral with a film (10) at a zone (114) located not superimposed on the corresponding closing element (110) in order to allow articulation of said web (112) on the film (10), characterized by the fact that the articulated web (112) extends beyond the closing element (110) such that upon engagement of the closing elements (110, 120), the end (115) of the articulated web (112) bears on a structure (20) opposite it.

9 Claims, 3 Drawing Sheets

(56) References Cited

U.S. PATENT DOCUMENTS

| | | | | |
|---|---|---|---|---|
| 6,550,965 | B2 * | 4/2003 | Shaffer et al. | 383/65 |
| 7,189,001 | B2 * | 3/2007 | Gerrits | 383/63 |
| 2002/0034344 | A1 * | 3/2002 | Bois | 383/61 |
| 2004/0008909 | A1 | 1/2004 | Shepard et al. | |
| 2004/0252916 | A1 * | 12/2004 | Smith et al. | 383/64 |
| 2005/0251973 | A1 * | 11/2005 | Sprehe | 24/399 |
| 2007/0183692 | A1 * | 8/2007 | Pawloski | 383/61.2 |
| 2008/0240625 | A1 * | 10/2008 | McCracken et al. | 383/64 |
| 2009/0214141 | A1 * | 8/2009 | Borchardt et al. | 383/63 |
| 2009/0324141 | A1 * | 12/2009 | Dais et al. | 383/59 |

OTHER PUBLICATIONS

JP09-077096Translation.*

Search Report from corresponding French Application 0858680, dated May 8, 2009.

* cited by examiner

State of the art

RESEALABLE PACKAGING BAG AND CLOSING ASSEMBLY FOR SAME

CROSS-REFERENCE TO RELATED APPLICATIONS

The present application claims the benefit of French Patent Application No. 0858680, filed Dec. 17, 2008. The disclosure of which is hereby incorporated herein by reference.

The present invention concerns the field of packaging bags.

More specifically, the present invention concerns the field of packaging bags comprising opening/closing means capable of multiple successive openings and closings, for example and non-limitingly in the form of complementary profiles.

Many packaging bags and many closing assemblies to that end have already been proposed.

Most of the known closing assemblies to this end comprise two complementary elements, for example of the male/female or Velcro/hook type, or complementary hooks, the hooks being supported by respective support webs.

Figure 1:
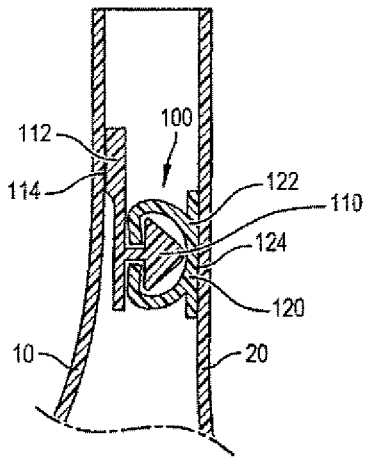

In the appended FIG. 1, we have shown the mouth of a resealable bag known from document FR-A-2628067.

In FIG. 1, one sees the two main walls 10, 20 of the bag at the mouth thereof. One also sees, in the appended FIG. 1, a closing assembly 100 comprising two complementary closing elements 110, 120 supported by respective webs 112, 122 secured on the films 10 and 20, respectively.

More specifically, the fixing zones of the support webs 112, 122 on the films 10 and 20 are referenced 114 and 124.

One will note upon examining FIG. 1 that the zone 114 for fastening the support web 112 on the film 10 is not superimposed on the male element 110, but offset in relation thereto. Alternatively this may involve an offset of the zone 124 for securing the support web 122 on the film 20 in relation to the female element 120. Thus, the web 112 forming the support for the male element 110 is articulated on the film 10 at the fixing zone 114. As described in document FR-A-2628067, the preceding arrangement makes it possible to avoid pressure inside the bag from being applied on the closing element 110, 120 and tending to separate them. Indeed, due to the arrangement previously described and illustrated in FIG. 1, the pressure inside the bag leads to a possible pivoting of the support web 110 at the articulation zone formed by its fastening, without risk of the closing elements 110, 120 separating.

The bags using the arrangement illustrated in FIG. 1 have already rendered great services.

However, the present invention aims to improve the state of the art by proposing new means making it possible to further improve sealing, in particular with regard to liquid contents.

The aforementioned aim is achieved in the framework of the present invention using a Bag comprising a closing assembly comprising two complementary elements supported by respective webs at least one of which is integral with a film at a zone located not superimposed on the corresponding closing element in order to allow the articulation of said web on the film, characterized by the fact that the articulated web extends beyond the closing element such that during engagement of the closing elements, the end of the articulated web bears on a structure opposite it and in that it also comprises a stress assembly between the walls of the bag, on the side of the closing assembly opposite the free end of the articulated web.

Figure 2:
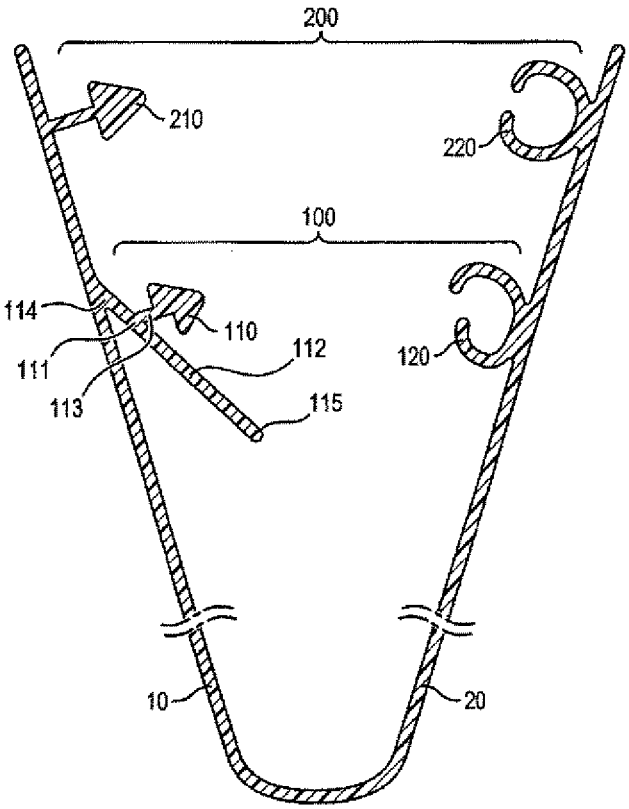
Figure 3:
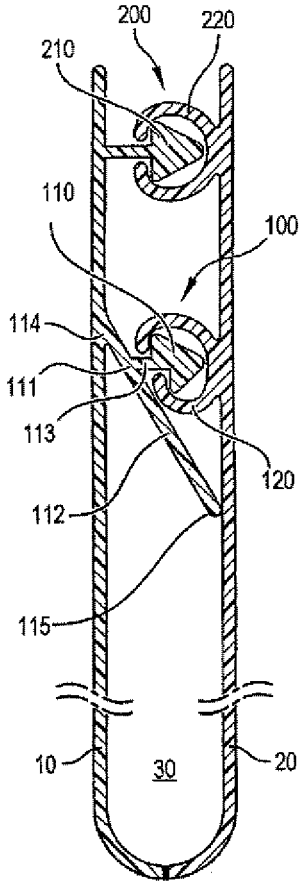
Figure 4:
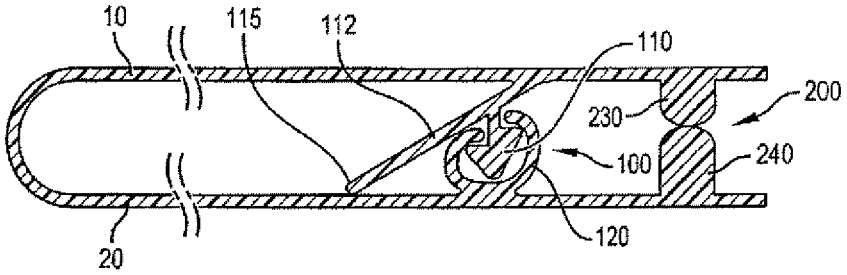
Figure 5:
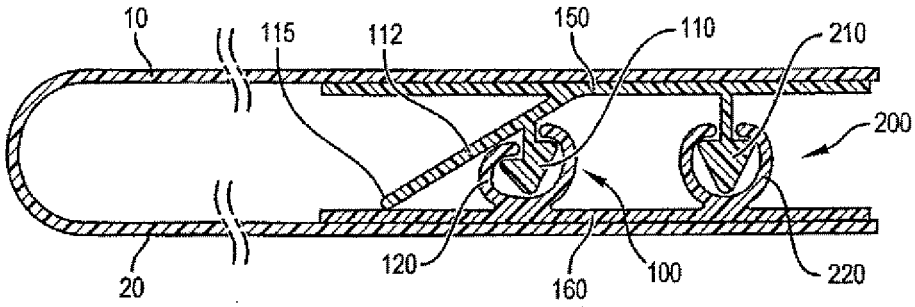
Figure 6:
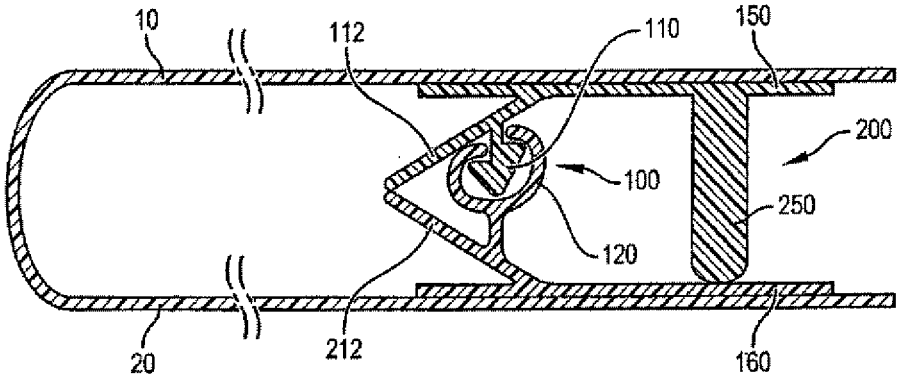
Figure 7:
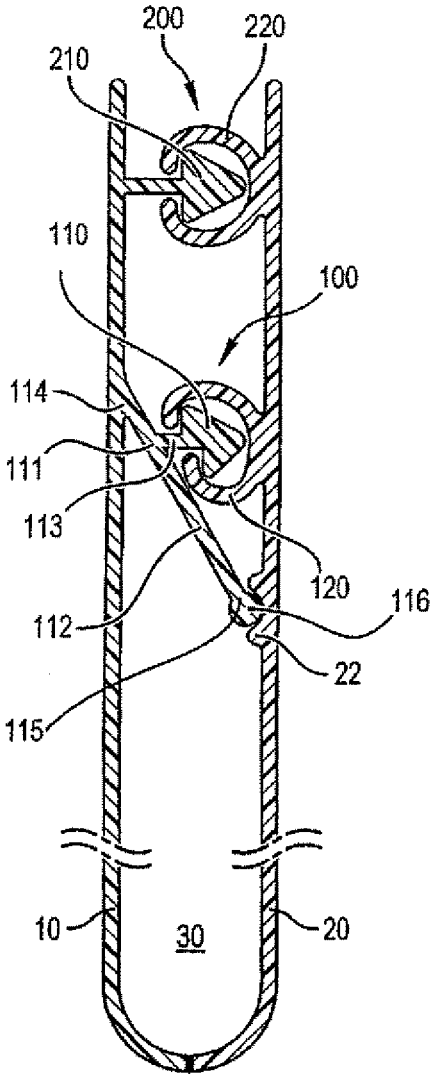
Figure 8:
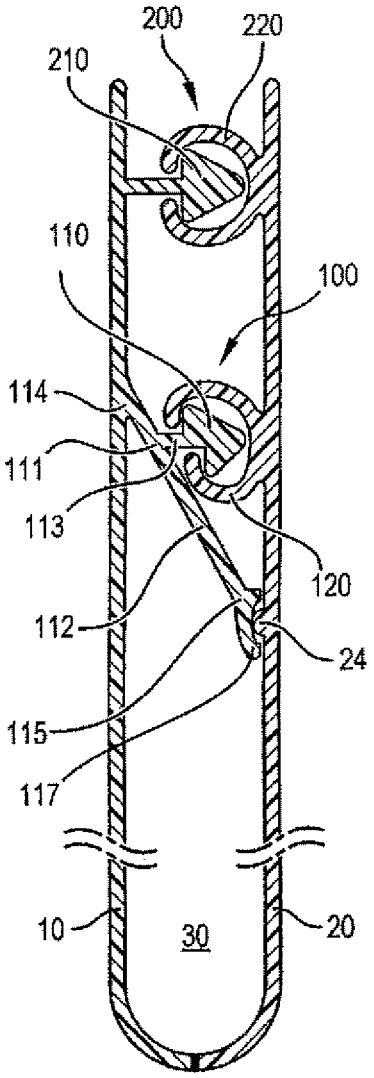

Other characteristics, aims and advantages of the present invention will appear upon reading the following detailed description, and with regard to the appended drawings provided as non-limiting examples, and in which:

The appended FIG. 1, previously described, diagrammatically illustrates the mouth of a bag according to the state of the art, FIG. 2 illustrates a partial cross-section of a bag according to the present invention, in its open state, FIG. 3 illustrates a view similar to FIG. 2, of the same bag, in the closed position, FIGS. 4, 5 and 6 illustrate three alternative embodiments according to the present invention, and FIGS. 7 and 8 illustrate two other alternative embodiments according to the present invention according to which the end of the articulated web and the support zone placed opposite have complementary geometric shapes.

In FIGS. 2 and 3, we have illustrated a bag according to the present invention. In these figures, one sees two main films 10, 20 traditionally forming a bag in itself. The particular method for realizing a bag of this type, in its general structure, will not be described in detail below.

The walls 10, 20 of the bag may be the object of many embodiments.

The walls are preferably made of thermoplastic materials.

These walls can be single or multi-layer and single or multi-material. If applicable, it may be a paper support coated with a layer of thermoplastic materials, or a metalized thermoplastic layer.

The bag can be realized using a single sheet folded on itself and welded on three sides or several sheets, for example two sheets welded together at their edges, preferably along edges connecting the main walls.

One also sees, in the appended FIGS. 2 and 3, a closing assembly 100 comprising two complementary closing elements, one 110 male, the other 120 a complementary female element.

In its general structure, such a closing assembly is known in itself and will therefore not be described in detail below.

One will also note that according to the invention, at least one of the two elements 110, 120 of the closing assembly 100 is supported by a support web 112 articulated on a wall 10 of the bag.

According to the embodiment illustrated in FIGS. 2 and 3, the articulated web 112 is integral, more precisely by extrusion, with the wall 10 of the bag and connected thereto in a zone referenced 114.

As illustrated in FIGS. 5 and 6, in variation, the articulated web 112 could be supported by an auxiliary web offset on the wall 10 and fastened thereto using any suitable means, preferably by heat sealing.

One will note that the connecting zone 114 between the articulated web 112 and the wall 10 of the bag does not coincide with the connecting zone 111 of the foot of the male element 110 on the articulated web 112.

Moreover, as illustrated in FIGS. 2 and 3, the web 112 extends beyond the male closing element 110, in relation to the connecting zone 114. In other words, the foot 113 of the male closing element 110 is situated between the articulation zone 114 and the free end 115 of the web 112.

Thanks to the previously described arrangements, as one sees in FIG. 3, when the closing elements 110, 120 are engaged, the end 115 of the web 112 is forced to bear on the opposite structure, in this case the wall 20 of the bag. Complete sealing is thus defined for any body, in particular liquids, placed in the internal volume 30 of the bag.

As one also sees in FIGS. 2 and 3, preferably, according to the invention, there is an additional stress assembly 200, between the walls 10, 20 of the bag. The purpose of the assembly 200 is to maintain a minimal gap between the walls 10 and 20 able to apply a lever arm on the walls 10 and 20 of a nature to stress the articulated web 112 bearing on the opposite structure.

According to the illustration provided in FIG. 3, the stress assembly 200 is made up of two complementary profiles, one male 210, the other female 220, similar to the closing 100 previously described. The structure of such an assembly 200 also being known in itself, it will not be described in more detail below.

In FIG. 4, we have shown an alternative embodiment according to which the stress assembly 200 is formed not by two complementary closing elements 210, 220, but by two complementary flanges 230, 240 supported by the respective inner faces of the walls 10 and 20.

Preferably, the assembly 200 is adapted to define a gap between the walls 10 and 20 at least essentially identical to the gap defined by the closing assembly 100.

Preferably in the framework of the present invention, as shown in the appended figures, the end 115 of the articulated support web 112 is oriented toward the inside of the bag. In this case, the additional stress assembly 200 is placed on the outside of the bag in relation to the closing assembly 100.

However, the opposite arrangement may be used. In other words, one may provide that the articulated support web 112 is oriented not toward the inside of the bag, but toward the outside thereof, in which case the additional closing assembly 200 would be placed on the inside of the bag in relation to the closing assembly 100.

As previously indicated, the stress element 200 is preferably placed between the films or walls 10, 20 of the bag on the side of the closing element 100 opposite the free end 115 of the articulated web 112.

Of course, the present invention is not limited to the embodiments just described, but extends to all variations in line with its spirit.

The stress assembly 200 may be subject to many variations. It may be not only a closing assembly with two complementary elements as illustrated in FIGS. 2, 3 and 5 or with two complementary flanges 230, 240 as shown in FIG. 4, but also, and non-limitingly, a single flange 250 as illustrated in FIG. 6.

The closing assembly 100 and the articulated support web 112 as well as the stress means 200 can be integral with the walls 10, 20 of the bag or supported by auxiliary webs 150, 160 themselves offset on the walls 10, 20 and secured thereon by any suitable means, for example by heat sealing.

In the appended FIGS. 2 to 5, the articulated support web 112 supports the male closing element 110. Alternatively, the articulated web 112 could support the female element 120.

According to still another alternative illustrated in FIG. 6, the two complementary closing elements 110, 120 can each be supported by an articulated web. In this case, it is the free ends of the two aforementioned articulated webs which are in contact when the closing assembly 110, 120 is engaged as shown in FIG. 6.

Preferably, in the framework of the present invention, the closing assembly 100, the related articulated web 112, and the stress assembly 200 are made in a thermoplastic material.

According to one alternative, at least the free end 115 of the articulated web 112 and/or the zone of the support element placed opposite, for example a zone of the wall 20, is made in a flexible material and/or in an elastomeric material having properties facilitating adhesion, able to guarantee close contact between said free end 115 of the articulated web 112 and the zone of the support element placed opposite it, in order to further strengthen sealing.

Moreover, if applicable, the closing assembly 100 and/or the stress means 200 are connected to a slider facilitating their opening/closing.

Such a slider is known in itself in its general structure and will therefore not be described in detail below. One will recall simply that in general, such a slider comprises a sole which supports two lateral sheets and a central wall defining two non-parallel channels between them receiving at least the apex of one of the two support webs of the closing assemblies or of the walls 10, 20, respectively, such that depending on the direction of movement of the slider, the latter part stresses the closing 100 and stress 200 assemblies upon opening and closing, respectively.

According to still another alternative embodiment, as illustrated in FIGS. 7 and 8, the free end 115 of the articulated web 112 and the zone of the support element placed opposite, have complementary geometric shapes adapted to cooperate by interlocking upon closing of the bags in order to strengthen sealing.

In FIG. 7 we have thus illustrated a free end 115 of the articulated web 112 comprising a convex flange 116 and a zone opposite the support element 20 having a concave groove 22 complementary to the flange 116. In the closing position, the flange 116 penetrates the groove 22 as shown in FIG. 7.

In FIG. 8, we have shown a free end 115 of the articulated web 112 comprising a concave groove 117 and a zone opposite the support element 20 having a convex flange 24 complementary to the groove 117. In the closing position, the flange 24 penetrates the groove 117 as shown in FIG. 8.

Of course, the flanges 116 or 24 and complementary concave grooves 22 or 117 illustrated in FIGS. 7 and 8 could be replaced by any suitable equivalent means.

The invention claimed is:

1. A bag comprising first and second opposing walls including at least one film and a closing assembly, the closing assembly having first and second complementary elements supported by and unitary with respective webs, said first and second complementary elements and their respective webs being made of the same constitutive material, wherein at least one of said webs is connected to the at least one film at a local portion which is not superimposed with the first complementary element in order to allow articulation of said web with respect to the first wall, said articulated web protruding from the first wall at the local portion and forming a non-zero angle with said first wall at the local portion, such that the articulated web extends towards the second wall, wherein said articulated web extends beyond the first complementary element such that, upon mutual engagement of the first and second complementary elements, a free end of said articulated web associated with the first complementary element is in contact with and is forced against a support element extending from the second wall, wherein one of said free end and said support element comprises a roll edge and the other of said free end and said support element comprises a U-shaped groove, said U-shaped groove including a first rib and a second rib, said first rib and said second rib being parallel to the first complementary element or the second complementary element, wherein said roll edge and said U-shaped groove have complementary geometric shapes, and wherein the bag also includes a stress assembly between the first and second walls of the bag, on the side of the closing assembly opposite the free end of said articulated web, the stress assembly being adapted to maintain a minimal gap between the first and second opposing walls and apply a lever arm on the first and second opposing walls to force said articulated web against said support element.

2. The bag according to claim 1, wherein the stress assembly defines a gap between the first and second walls of the bag, the gap being essentially identical to a gap defined by the closing assembly.

3. The bag according to claim 1, wherein the stress assembly comprises one of the following elements:

third and fourth complementary elements, such elements being capable of hooking;

first and second flanges supported by the first and second walls of the bag, respectively; or a flange supported by at least one of the first and second walls of the bag.

4. The bag according to claim 1, wherein said articulated web is oriented towards an inside of the bag.

5. The bag according to claim 1, wherein said articulated web is integral by extrusion with the first or second wall of the bag.

6. The bag according to claim 1, wherein said articulated web and at least one of the first and second complementary elements are supported by auxiliary support webs attached and fixed to the first and second walls of the bag, respectively.

7. The bag according to claim 1, wherein one of the first and second complementary elements of the closing assembly is of the male type, while the other is of the female type.

8. The bag according to claim 1, wherein at least the free end of said articulated web or the support element, or both, are made of a flexible material configured to enable close contact between the free end of said articulated web and the support element in order to strengthen sealing.

9. The bag according to claim 1, wherein at least the free end of said articulated web or the support element, or both, are made of an elastomeric material having properties facilitating adhesion, such elastic material being configured to enable close contact between the free end of said articulated web and the support element in order to strengthen sealing.

* * * * *